US008727149B1

(12) United States Patent
Reid et al.

(10) Patent No.: US 8,727,149 B1
(45) Date of Patent: May 20, 2014

(54) CONTAINER WITH STORED SCOOP

(75) Inventors: Grahame W. Reid, Novato, CA (US); Donald Waring, Rohnert Park, CA (US); David Lloyd, Santa Rosa, CA (US)

(73) Assignee: Innovative Molding, Sebastapol, CA (US)

( * ) Notice: Subject to any disclaimer, the term of this patent is extended or adjusted under 35 U.S.C. 154(b) by 538 days.

(21) Appl. No.: 12/653,734

(22) Filed: Dec. 16, 2009

Related U.S. Application Data

(63) Continuation-in-part of application No. 12/322,175, filed on Jan. 28, 2009.

(51) Int. Cl.
*B65D 41/26* (2006.01)

(52) U.S. Cl.
CPC ..... *B65D 41/26* (2013.01)
USPC ..... 215/228; 220/212

(58) Field of Classification Search
USPC ..... 220/212, 255, 256.1, 212.5, 359.1, 220/574.1, 735; 215/228, 232; 426/115, 426/132; 206/223, 541, 542
See application file for complete search history.

(56) References Cited

U.S. PATENT DOCUMENTS

| | | | | |
|---|---|---|---|---|
| 3,624,787 | A | 11/1971 | Newman | |
| 3,679,093 | A | 7/1972 | Chang | |
| 4,216,875 | A | 8/1980 | Stanish | |
| 5,005,719 | A | 4/1991 | Phillips et al. | |
| 5,090,572 | A | 2/1992 | DeRoseau | |
| 5,251,774 | A * | 10/1993 | Engle | 220/212 |
| 5,415,309 | A | 5/1995 | Wang | |
| 5,705,212 | A | 1/1998 | Atkinson | |
| 5,706,974 | A * | 1/1998 | Murdick et al. | 220/735 |
| 5,749,460 | A * | 5/1998 | Rice | 220/23.83 |
| 5,915,585 | A * | 6/1999 | Ladina et al. | 220/522 |
| 6,216,856 | B1 * | 4/2001 | Park | 206/214 |
| 6,604,645 | B1 | 8/2003 | Vaupotic | |
| 6,604,646 | B2 | 8/2003 | Torniainen et al. | |
| 7,175,041 | B2 | 2/2007 | Ekkert | |
| D572,538 | S | 7/2008 | Epstein et al. | |
| D576,035 | S | 9/2008 | Perry et al. | |
| D578,401 | S | 10/2008 | Perry et al. | |
| D599,617 | S * | 9/2009 | Ye | D7/401.2 |
| 7,947,928 | B2 * | 5/2011 | Tynes et al. | 219/433 |
| 8,042,704 | B2 * | 10/2011 | Borowski et al. | 220/574.1 |
| 8,087,530 | B2 * | 1/2012 | Stevens | 220/212 |
| 8,210,381 | B2 * | 7/2012 | Cross | 220/212.5 |
| 8,469,223 | B2 * | 6/2013 | Perry et al. | 220/608 |
| 2001/0045374 | A1 * | 11/2001 | Selker | 206/542 |
| 2004/0094548 | A1 | 5/2004 | Laveault | |

(Continued)

FOREIGN PATENT DOCUMENTS

| | | |
|---|---|---|
| GB | 2250271 | 6/1992 |
| JP | 2000107052 | 4/2000 |

(Continued)

*Primary Examiner* — Robert J Hicks
*Assistant Examiner* — Kareen Rush
(74) *Attorney, Agent, or Firm* — Woodard Emhardt Moriarty McNett & Henry, LLP

(57) ABSTRACT

A container with a granulated, powdered or other loose product stores a scoop within the container adjacent to a closure for the container, in such a way that the scoop will not sink down into the product. Several embodiments are disclosed, including different ways for retaining the scoop. Promotional material can be retained below the closure, in addition to or in lieu of the scoop.

18 Claims, 4 Drawing Sheets

(56) References Cited

U.S. PATENT DOCUMENTS

| | | | | |
|---|---|---|---|---|
| 2007/0102061 | A1* | 5/2007 | Tsao | 141/380 |
| 2008/0041861 | A1* | 2/2008 | Crawford et al. | 220/697 |
| 2008/0093366 | A1 | 4/2008 | McKahan et al. | |
| 2008/0156808 | A1 | 7/2008 | Perry et al. | |

FOREIGN PATENT DOCUMENTS

| | | |
|---|---|---|
| JP | 2000287807 | 10/2000 |
| JP | 2004315068 | 11/2004 |
| JP | 2007137510 | 6/2007 |

* cited by examiner

CONTAINER WITH STORED SCOOP

This is a continuation-in-part of application Ser. No. 12/322,175, filed Jan. 28, 2009.

BACKGROUND OF THE INVENTION

The invention concerns containers for various products, and in particular relates to containers with molded plastic, threaded closures for products such as powdered concentrates that require a scoop.

Protein powders, weight gain formulas, weight loss formulas, vitamin and mineral supplement powders and similar products are usually sold in containers with plastic threaded closures. These are often relatively large-mouth containers, often 110 mm or 120 mm in diameter. Powdered products that are for mixing by the consumer into water or other liquid beverages often are sold with a scoop, a simple plastic device placed directly in the container with the powdered product. Even if placed on the top surface of the powdered product, the scoop will work its way down into the powder during shipping, and therefore the consumer must retrieve the scoop by hand, reaching into the powder, which produces a messy and objectionable situation.

There have been some approaches to this problem. In one approach, a powdered baby formula container, non-threaded, had a closure secured to the container in a normal way but the closure had an upper part to house a scoop. For access to the scoop the closure was swung upwardly on a hinge. The powdered contents were sealed into the container, with a liner secured to the upper rim of the non-threaded container. See U.S. Published Application No. 2008/0156808.

A simpler and more efficient way of storing a scoop separate from a powdered or liquid concentrate product is needed, especially for threaded closures and for the case in which products are for human consumption.

In addition to the above published application, the following patents and publications show prior approaches to storing a scoop or utensil in or adjacent to a cap, sometimes to prevent the utensil from being submerged in the contained product: U.S. Pat. Nos. 7,175,041, 5,705,212, 5,415,309, 5,090,572, 4,216,875, 3,679,093, 3,624,787, D572,538, U.S. pub. No. 2008/0093366, Japan pub. app. Nos. 2007-137510, 2004-315068, 2000-287807, 2000-107052 and Great Britain pub. app. No. 2 250 271.

Of the above patents and publications, U.S. Pat. Nos. 5,705,212 and 7,175,041 show storage and retention of a utensil or scoop within some form of cap. In the former the utensil is in a snapped-on, non-threaded overcap; in the latter the scoop is held up against the top panel inside a deep threaded cap.

SUMMARY OF THE INVENTION

In several embodiments of this invention a scoop is retained in a container, adjacent to a container closure so as not to be submerged in the product. In one form of the invention, the scoop is held directly inside the container and up against the liner, which is initially assembled into the cap. For example, the scoop can be held in place on the liner by a glue dot, until removed by the consumer.

In another embodiment of the invention the mouth of the container is formed to support the scoop. This can be a channel, slot, lip or ridge formed on the inside surface of the plastic container mouth, such that the scoop, which extends across the interior of the bottle finish, does not interfere with the engagement of the container closure or the seal.

In all cases of a granulated or powdered product, the consumer, after opening the container, can simply place the scoop on the top surface of the powder between uses. The problem of objectionable sinking down into the powder occurs only during shipment.

In some embodiments, promotional materials can be retained in the container, along with the scoop or alternative to the scoop.

It is therefore among the objects of the invention to conveniently store a scoop of the type used for powder or liquid concentrates within a container of the product, or to store another article, in such a way that the article will not sink down into the product. These and other objects, advantages and features of the invention will be apparent from the following description of a preferred embodiment, considered along with the accompanying drawings.

DESCRIPTION OF PREFERRED EMBODIMENTS

Figure 1:
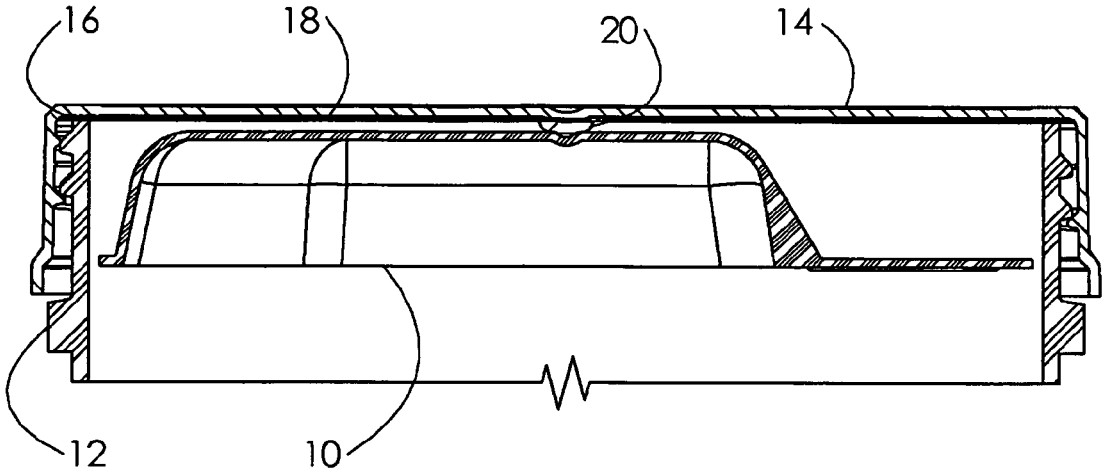
FIG. 1 is an elevation view in section showing an embodiment of the invention.

FIG. 1 shows one embodiment of the invention for retaining a scoop 10 in position to prevent the scoop from sinking down into a granular, powdered or liquid product in a container 12 (usually a molded plastic wide-mouthed bottle or jar). In this form of scoop retention the scoop 10 is directly inside the product container 12, and a closure 14 of conventional design can be used. Between the closure and the container finish 16 is a liner 18, preferably sealed in place by induction heating. The scoop 10 is simply retained to the underside of the liner by a glue dot 20, of known composition suitable for contact with food products. The glue dot will readily release the scoop when the scoop is pulled with some force away from the liner by a consumer, who will have first removed the liner from its sealed connection to the container finish after the consumer has removed the cap 14.

Figure 2:
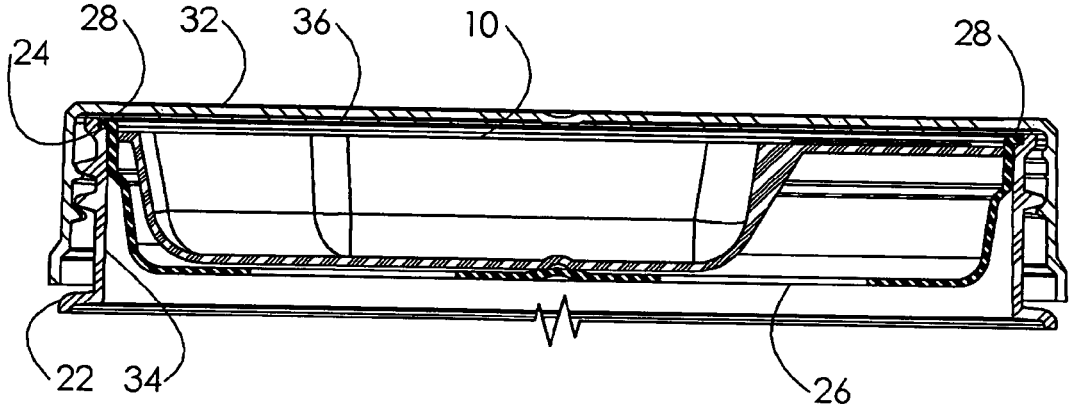
FIG. 2 is a sectional elevation view showing a container and closure with a scoop, in another embodiment of the invention.
Figure 3:
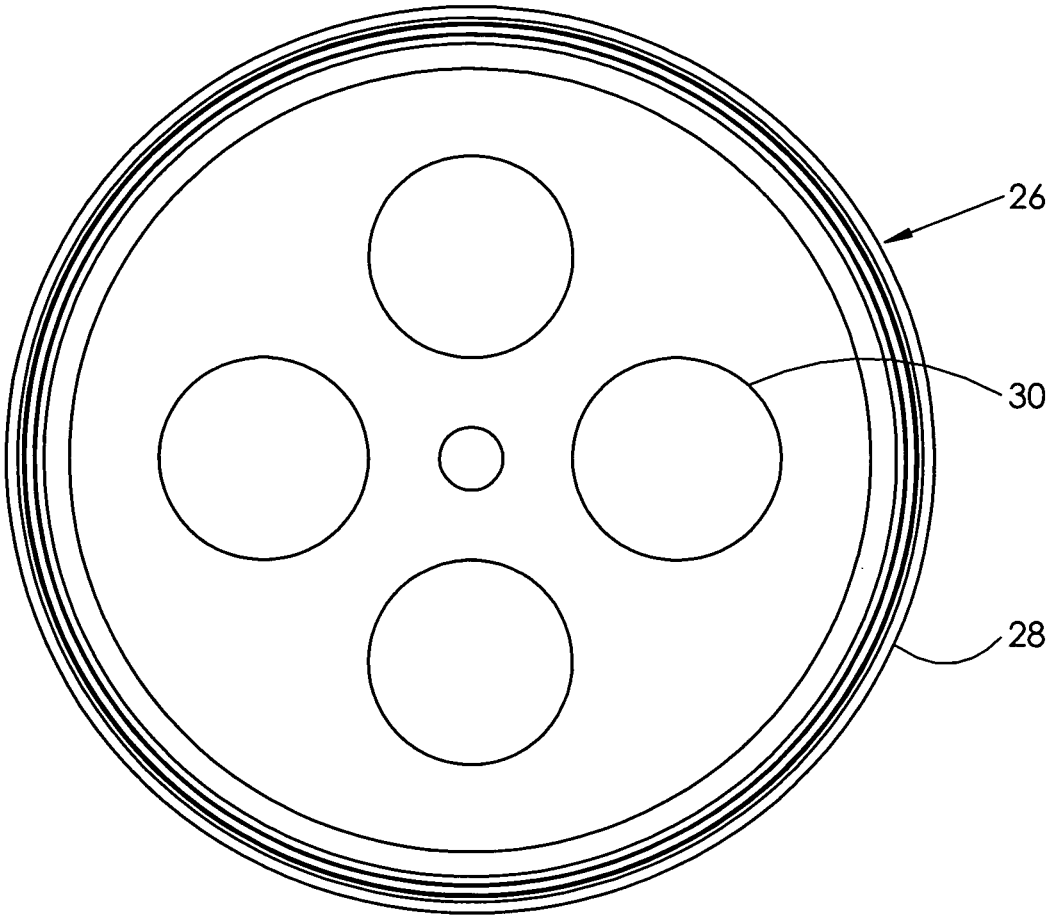
FIG. 3 is a plan view showing a scoop-retaining basket that forms part of the assembly of FIG. 2.

In FIG. 2 is shown another form of scoop retention within the container. Here, a container 22 has an internal ledge 24 in the container finish, forming an annular shelf on which a basket 26 can rest. The basket 26, shown in plan view in FIG. 3, has an outer annular lip 28 that is sized to rest on the ledge 24 so that it is captured in that position and prevented from falling down into the container. The basket can have a perforated bottom, with holes shown at 30 in FIG. 3; the perforated bottom could take other forms as well, such as a lattice work pattern with square openings, although the basket preferably is injection molded, without weaving.

A scoop 10 is held within the basket 26, as shown. FIG. 2 also shows a closure 32 secured on the container neck 34 via threads. If desired the annular ledge 24 of the container finish can be set at a level such that the container lid 32, when engaged on the container finish, or a liner 36 on the inside of the container lid, will come into contact with the basket lip 28 or the top surface of the scoop 10 (or approximately into contact), to eliminate or reduce freedom of movement of the basket and the scoop within the container.

Figure 4:
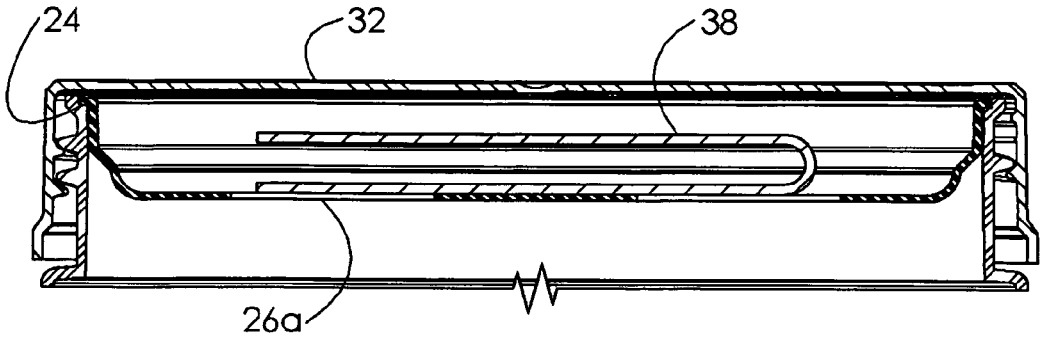
FIG. 4 is a sectional elevation view showing promotional materials retained within the container rather than a scoop.

FIG. 4 shows a modified form of the invention, again with a basket 26*a*, in this case a shallow basket, resting on the ledge or rim 24 of the container finish. The container lid is shown at 32. In this case the basket 26*a* retains something other than a scoop, and this may be promotional materials such as indicated in the basket at 38. These promotional articles can be printed paper or other material, or bonus items, toys for children, etc. If desired, the container closure 32 can be sufficiently transparent to reveal the promotional material, toy, etc. in the closed container.

Figure 5:
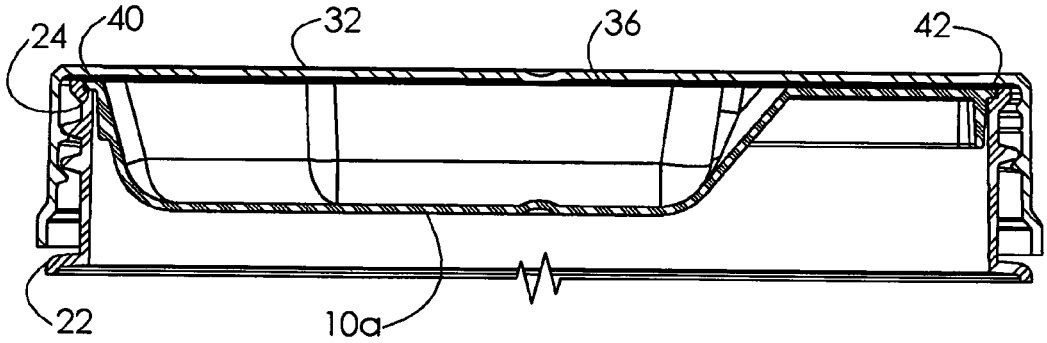
FIG. 5 is a cross sectional view showing a further embodiment wherein a scoop is retained within the neck of a container.
Figure 6:
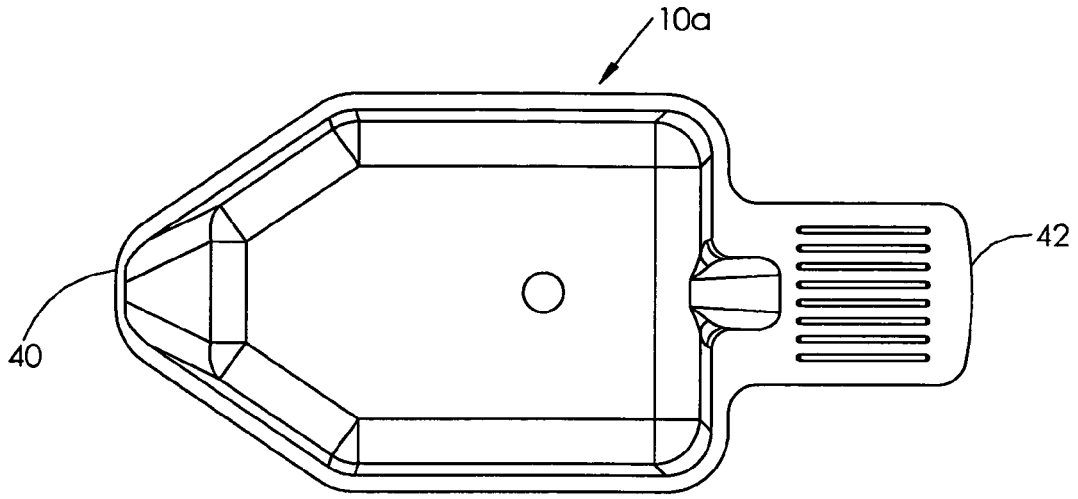
FIG. 6 is a plan view showing a scoop.

In the variation shown in FIG. 5, a scoop 10*a* is retained directly on the container finish, on an internal ledge 24 as shown, without the need for a retention basket. The scoop, which can be configured as in FIG. 6, has a small front end flange 40 and a handle tail end 42, both of which rest on the annular ledge or rim 24, the length of the scoop being such that it is captured in position. Again, the dimensions of the container finish, i.e. the distance from the ledge to the top of the finish, can be such as to capture the scoop closely against or adjacent to the inside surface of the container lid 32 or a liner 36 on the inside of the lid.

Figure 7:
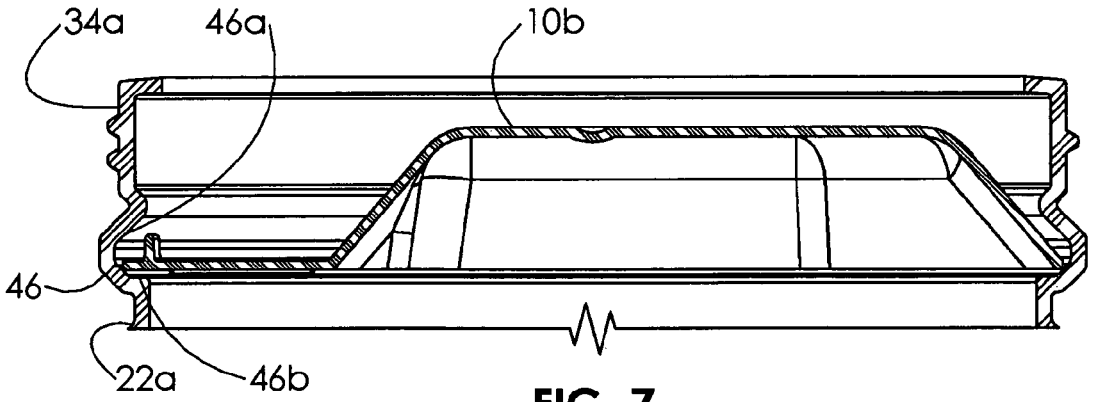
FIG. 7 is a sectional view showing an alternative to the form of scoop retention shown in FIG. 4.

FIG. 7 shows an alternative container 22*a*, typically an extrusion blow-molded container. A container neck 34*a* of a container formed by this process typically has an annular deformation 46 that forms an internal annular groove 46*a* in the neck, as shown. This can be formed in the blow molding of the neck, and typically an outer bead 46 will also be present as schematically indicated. In an extrusion blow-molded container, the container body is extruded but the container neck 34*a* is formed into the desired configuration in a separate process, which is a blow molding process. This is typically a polyethylene container. Some thickness variation occurs from container to container at the inner side of the container neck due to the blow molding process, but the process affords sufficient control that either a basket (for a retention of a scoop or other items) or a scoop 10*b* without a basket, can rest on the ledge 46*b* formed in the groove 46*a* at the inside of the neck as shown. This requires that the scoop 10*b* (or a basket) be snapped into the groove by a bending deformation of the scoop as it is pushed down into place. Similarly the scoop is deformed slightly on removal.

As shown in FIG. 4, promotional material can be retained in space just below the cap, and the cap can be sufficiently translucent or essentially transparent to display the materials, bonus items, toys, etc. Promotional material or other generally flat articles can also be held between the scoop and the top panel of the cap in the arrangements shown in FIGS. 2, 5 and 7. The term promotional material is intended to include any such printed or non-printed items.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. In combination:

a container for retaining product, said container having a generally cylindrical neck with external threads and an interior ledge, said container neck defining an interior and including a container finish at a top end of the neck;

product retained in said container;

a liner adhered and sealed to the container finish thus sealing the product within the container;

a threaded closure screwed onto the threaded container neck and bearing down against the liner, said threaded closure having a generally cylindrical skirt with internal threads and with a skirt diameter; and a scoop positioned within the container below the liner and held in place within the interior of the container neck, the scoop extending across the interior of the container neck with opposite ends of the scoop resting on the ledge, in a space defined between the liner and the product in the container.

2. The combination of claim 1, further including a basket within the container neck resting on the ledge below the liner, the basket being removable from the container, with the scoop retained in the basket.

3. The combination of claim 1, further including promotional material in the container, held between the scoop and the liner.

4. The combination of claim 3, wherein the liner and a top panel of the closure are sufficiently translucent as to allow viewing of the promotional material from outside the closed container.

5. A container and threaded closure combination accompanied by a scoop for product retained in the container, comprising:

a container having a generally cylindrical neck with external threads, and a container finish at a top end of the neck;

product retained in the container;

a liner adhered and sealed to the container finish for sealing the product within the container;

a threaded closure screwed onto the threaded container neck and bearing down against the liner, the closure having a generally cylindrical skirt with internal threads and with a skirt diameter; and a scoop within the container, below the liner and held in place by adhesion to the bottom surface of the liner such that the scoop is removable from the container and from the liner.

6. The combination of claim 5, wherein the scoop is retained in the liner using a food grade glue dot.

7. A container and threaded closure combination accompanied by a scoop for product retained in the container, comprising:

a container having a neck with external threads, and a container finish at a top end of the neck;

product retained in the container;

a liner adhered to the container finish for enclosing the product within the container;

a threaded closure screwed onto the threaded container neck and advanced so as to contact the liner, the closure having an annular skirt with internal threads;

a scoop positioned within the container, below the liner, in a space defined between the liner and the product in the container; and an inner ledge formed on said container neck for retaining the scoop within said space, wherein said scoop spans said inner ledge with opposite ends of said scoop resting on said inner ledge.

8. A container and threaded closure combination accompanied by a scoop for a-product retained in the container, comprising:

a container having a generally cylindrical neck with external threads, and a container finish at a top end of the neck;

product retained in said container;

a liner adhered and sealed to the container finish for sealing the product within the container;

a threaded closure screwed onto the threaded container neck and bearing down against the liner, the closure having a generally cylindrical skirt with internal threads and with a skirt diameter;

a scoop within the container, below the liner and held in place on the interior of the container neck, in a space defined between the liner and the product in the container, with means for retaining the scoop within the space; and wherein the container has a neck that includes an internal annular groove forming an internal ledge, and the scoop being snapped into the annular groove and held therein by two opposed ends of the scoop resting on the internal ledge, the length of the scoop between the two opposed ends being such as to require bending deformation of the scoop on insertion and removal from the annular groove.

9. A container and threaded closure accompanied by a scoop for a product in the container, comprising:

a container having a generally cylindrical neck with external threads, and a container finish at a top end of the neck, said container including a ledge which is formed on the interior of the neck;

a threaded closure screwed onto the threaded container neck, the closure having a generally cylindrical skirt with internal threads and with a skirt diameter; and a scoop within the container which is positioned on the interior of the container neck by means of said ledge, said scoop extending across the interior of the container neck with opposite ends of the scoop resting on the ledge.

10. The container and threaded closure of claim 9 wherein said ledge is continuous.

11. The container and threaded closure of claim 9 wherein said ledge is annular.

12. A container and threaded closure accompanied by a scoop for a product in the container, comprising:

a container having a generally cylindrical neck with external threads, and a container finish at a top end of the neck;

a threaded closure screwed onto the threaded container neck, the closure having a generally cylindrical skirt with internal threads and with a skirt diameter; and a scoop within the container which is positioned on the interior of the container neck, said container neck including means formed on its interior for supporting said scoop, said scoop having a first end positioned in contact with said means for supporting and a second, opposite end positioned in contact with said means for supporting.

13. The container and threaded closure of claim 12 wherein said means for supporting includes an internal annular ledge.

14. A container and threaded closure combination accompanied by a scoop for product retained in the container, comprising:

a container having a generally cylindrical neck with external threads, and a container finish at a top end of the neck;

product retained in said container;

a liner adhered and sealed to the container finish for sealing the product within the container;

a threaded closure screwed onto the threaded container neck and bearing down against the liner, the closure having a generally cylindrical skirt with internal threads and with a skirt diameter;

a scoop within the container, below the liner and held in place on the interior of the container neck, in a space defined between the liner and the product in the container, with means for retaining the scoop within the space; and wherein the container has a neck that includes an internal form which creates a ledge, and the scoop being snapped into the internal form and held therein by two opposed ends of the scoop resting on the ledge, the length of the scoop between the two opposed ends being such as to require bending deformation of the scoop on insertion and removal from the internal form.

15. The container and threaded closure combination of claim 14 wherein said ledge is annular.

16. A container and threaded closure combination accompanied by a scoop for product retained in the container, comprising:

a container having a generally cylindrical neck with external threads, and a container finish at a top end of the neck;

product retained in said container;

a liner adhered and sealed to the container finish thus sealing the product within the container;

a threaded closure screwed onto the threaded container neck and bearing down against the liner, the closure having a generally cylindrical skirt with internal threads and with a skirt diameter;

a scoop within the container, below the liner and held in place on the interior of the container neck, in a space defined between the liner and the product in the container, with means for retaining the scoop within the space;

a ledge formed on the interior of the container neck; and a basket positioned within the container neck resting on the ledge below the liner, the basket being removable from the container, with the scoop retained in the basket, wherein the ledge is continuous around the interior of the container neck, and the basket including an outwardly extending flange which rests on the ledge.

17. A container and threaded closure combination accompanied by a scoop for product retained in the container, comprising:

a container having a generally cylindrical neck with external threads, and a container finish at a top end of the neck;

product retained in said container;

a liner adhered and sealed to the container finish for sealing the product within the container;

a threaded closure screwed onto the threaded container neck and bearing down against the liner, the closure having a generally cylindrical skirt with internal threads and with a skirt diameter;

a scoop within the container, below the liner and held in place on the interior of the container neck, in a space defined between the liner and the product in the container, with means for retaining the scoop within the space;

a ledge formed on the interior of the container neck; and a basket positioned within the container neck resting on the ledge below the liner, the basket being removable from the container, with the scoop retained in the basket, wherein the basket is of molded plastic and has a bottom with a plurality of holes.

18. A container and threaded closure combination accompanied by a scoop for product retained in the container, comprising:

a container having a generally cylindrical neck with external threads, and a container finish at a top end of the neck;

product retained in said container;

a liner adhered and sealed to the container finish for sealing the product within the container;

a threaded closure screwed onto the threaded container neck and bearing down against the liner, the closure having a generally cylindrical skirt with internal threads and with a skirt diameter; and a scoop within the container, below the liner and held in place on the interior of the container neck, in a space defined between the liner and the product in the container, with means for retaining the scoop within the space, wherein the container is an extruded blow-molded container, said neck including an internal annular groove forming an internal ledge, and the scoop being snapped into the annular groove and held therein by two opposed ends of the scoop resting on the internal ledge, the length of the scoop between the two opposed ends being such as to require bending deformation of the scoop on insertion and removal from the annular groove.

* * * * *